United States Patent [19]

Laing

[11] Patent Number: 4,476,644

[45] Date of Patent: Oct. 16, 1984

[54] FIREARM SAFETY WITH ALARM

[76] Inventor: Jerry R. Laing, 1383 Cal Young Rd., Eugene, Oreg. 97401

[21] Appl. No.: 427,594

[22] Filed: Sep. 29, 1982

[51] Int. Cl.[3] ..... F41C 27/00; F41C 17/00

[52] U.S. Cl. ..... 42/1 A

[58] Field of Search ..... 42/1 A

[56] References Cited

U.S. PATENT DOCUMENTS

| | | | |
|---|---|---|---|
| 666,405 | 1/1901 | Baggett | 42/1 A |
| 2,134,406 | 10/1938 | Jacobs | 42/1 A |
| 3,044,204 | 7/1962 | Zimmerman | 42/1 A |
| 3,842,526 | 10/1974 | Dixon | 42/1 A |
| 4,007,553 | 2/1977 | Clegg | 42/1 A |

*Primary Examiner*—Charles T. Jordan

*Attorney, Agent, or Firm*—James D. Givnan, Jr.

[57] ABSTRACT

A safety device for cooperation with the internal safety mechanism of a firearm to provide an audible signal to the shooter when the safety is off and the weapon is ready to fire. A main body member located adjacent the firearm trigger guard at the location of the conventional safety defines a chamber within which an alarm system is housed including a power source as well as signal generating means. A switch closing member is disposed so as to contact the trigger guard when the safety is off to close a signal generating circuit of the alarm. The alarm system is of modular construction for removable disposition within the main body chamber.

4 Claims, 4 Drawing Figures

FIREARM SAFETY WITH ALARM

BACKGROUND OF THE INVENTION

The present invention pertains generally to firearm safety mechanisms and particularly to such a mechanism which generates a signal indicating to the shooter that the weapon is ready to fire.

Most all firearms, including rifles and shotguns and some handguns are equipped with safety devices which mechanically lock the triggers thereof against actuation and firing of the weapon. Typically the "safetied" or "unsafetied" status of a weapon is determined by touch or visual checking of the safety device. While such devices are highly practical for their intended purpose and when used properly prevent inadvertent firing, the fact remains that many people are injured or killed each year by the accidental firing of a weapon thought to be "on safety". Accordingly, a problem exists that conventional safety devices, for some reason or other, perhaps their minute size and location on the underside of the weapon, are occasionally disregarded or misinterpreted resulting in accidental discharge of the weapon sometimes with tragic consequences.

SUMMARY OF THE PRESENT INVENTION

The present invention is embodied within a gun safety device which generates a signal warning the shooter that the weapon is not on safety and hence ready to fire.

In accordance with the present invention, the standard or original push-pull safety is replaced by a self contained signal emiting safety device which is accommodated within existing gun structure without modification in most instances. Gun safety devices are commonly embodied within an axially positionable member which, in an operative position, mechanically prevents trigger actuation. Such devices are generally of cylindrical shape and include means such as annular recesses for retentive engagement with cooperating means in the trigger guard of the gun or adjacent structure.

The present safety device continues to coact with and operate the gun safety mechanism in the usual manner. An alarm system is housed within an enlarged end segment of the present device. Inward displacement of the present device toward the trigger guard results in the closing of an alarm circuit which may include an audible signal generator.

Important objectives include the provision of a safety signaling device highly compatible with a great number of existing safety mechanisms in a wide range of weapons to permit convenient installation in new or retrofitting of used weapons with a safety device which indicates to the shooter the ready status of the weapon; the provision of a safety device having an encapsulated modular alarm system which is not susceptible to failure under adverse operating conditions.

DETAILED DESCRIPTION OF THE PREFERRED EMBODIMENT

Figure 1:
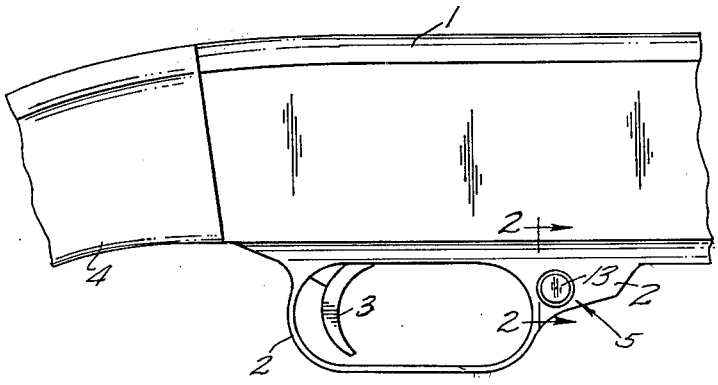
FIG. 1 is a fragmentary side elevational view of the receiver of a firearm with the present safety in place thereon.

With continuing attention to the drawing wherein applied reference numerals indicate parts similarly hereinafter identified, the reference numeral 1 indicates a receiver of a shotgun fitted with the present safety device which device is equally adaptable to the earlier mentioned firearms. The firearm includes a trigger guard 2, trigger 3 and a stock 4 all more or less typical.

Indicated generally at 5 is the safety device embodying the present invention. Said device includes a cylindrical main body 6 adapted for reception within an opening 7 typically provided in the trigger guard structure. While the safety device is shown disposed within the forward portion of trigger guard 2, it is to be understood that the device is equally adaptable for use in those weapons wherein the safety is located rearwardly of the trigger 3.

A reduced segment 6A of safety device 5 is slidably received within opening 7 with axial movement in oppoite directions being limited by a lock ring 8 seating in axially spaced apart annular grooves 10 and 11. Details of the interlock between segment 6A and the trigger actuated linkage is superfluous to an understanding of the present safety device and accordingly is omitted. Further such linkage may vary between makes and models of the present types of firearms.

Conventional gun safety devices are commonly operated in a push-pull manner with fingertip pressure exerted inwardly toward the trigger guard to release the safety mechanism, and conversely, pulled or pushed in an opposite outward direction to lock the trigger against movement. Typically to facilitate rapid release of a safety, the same is located adjacent the firearm trigger guard and moves in the same direction as the trigger finger during entry into the trigger guard.

Figure 2:
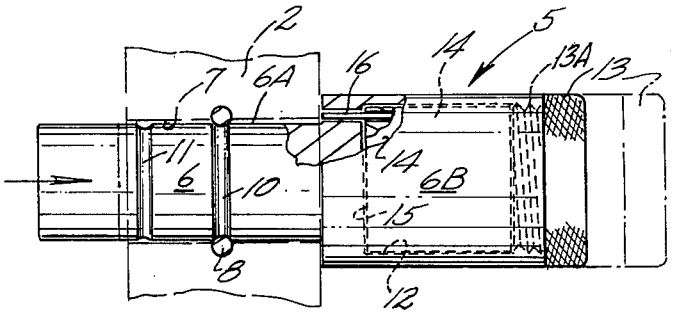
FIG. 2 is a vertical sectional view taken along line 2—2 of FIG. 1 with safety parts broken away for purposes of illustration and the trigger guard shown in phantom lines.
Figure 3:
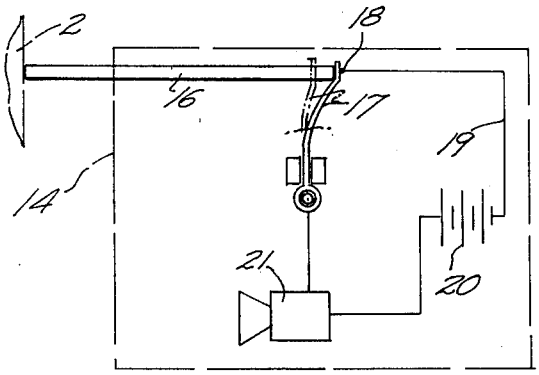
FIG. 3 is a schematic of the present safety alarm system modular base.
Figure 4:
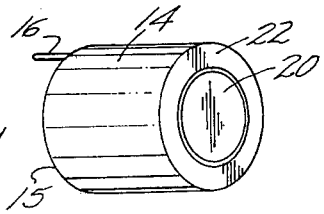
FIG. 4 is a perspective view of the modular alarm system component of the present safety device.

With attention again to the safety device, the same includes an enlarged head segment 6B having a chamber 12 formed therein. A cap at 13 is in removable engagement at 13A with threads formed in the chamber end. Housed within chamber 12 is modular base 14 which, as shown in FIG. 4, may be of cylindrical configuration and adapted for insertion into chamber 12. Projecting forwardly from a front wall 15 of the modular base is an actuating member 16 for contact with the trigger guard 2. Member 16 is slidably supported within front wall 15 of the modular base so as to actuate a later described alarm system upon displacement subsequent to contact with a firearm surface such as with trigger guard structure for example. In the schematic of FIG. 3, the inner end of inwardly displaced member 16 serves to close a switch arm 17 against a contact 18 to complete an electrical circuit 19 including a power source 20 and a signal generator 21 which may be in the form of a sound emitting device to provide upon circuit closure an audio signal to the shooter. Upon fingertip repositioning of the safety outwardly or away from the trigger guard, per the arrow in FIG. 2, member 16 permits resilient switch arm 17 to move to a circuit opening position. While the illustration is of a safety device for a right handed shooter, the present device, in similarity to other safety devices, is capable of reverse installation within the trigger guard for a left handed shooter.

It is understood that the schematic is intended to be primarily explanatory rather than illustrative of the modular base interior. If desired, the signal generated may be a visual signal but such is less desirable than an audio signal for obvious reasons.

With reference to FIG. 4, it will be seen that the power source, battery 20, may be of disk shape for insertion into a receptacle formed in a rear wall 22 of the modular base to permit convenient replacement.

The sound emitted by the present device would be of a low level to be heard only by the shooter and would be continued until the safety is repositioned to permit actuating member 16 to be biased outwardly by switch arm 17.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A safety device for a firearm to provide a signal to a shooter that a firearm safety is off and the firearm is ready to fire, said device comprising in combination, a main body member adapted for support by the trigger guard structure of the firearm in a manner permitting limited rectilinear movement of the main body member to a first position to obstruct trigger operation and movement to a second position to permit normal trigger operation, and an alarm system carried by said main body member, said alarm system including a power source, signal generating means, switch means in circuit with said power source and said signal generating means, said switch means closeable upon said main body member being manually positioned to said second position permitting normal trigger operation and energizing said signal generating means indicating to the shooter that the firearm is ready to fire.

2. The firearm safety device claimed in claim 1 wherein said switch means includes an actuating member contactible with the firearm.

3. The firearm safety device claimed in claim 1 wherein said main body member defines a chamber, said alarm system housed within said chamber.

4. The firearm safety device claimed in claim 3 wherein said alarm system is mounted on a modular base, said switch means including an actuating member projecting outwardly from said base for contact with the firearm.

* * * * *